33-246 SR

11/3/81 XR 4,297,789

United States Patent [19]

Tominaga

[11] 4,297,789

[45] Nov. 3, 1981

[54] LENS-FREE SIGHTING DEVICE

[75] Inventor: Hideo Tominaga, Tokyo, Japan

[73] Assignee: Fontaine Industries, Inc., Garden Grove, Calif.

[21] Appl. No.: 67,907

[22] Filed: Aug. 20, 1979

[51] Int. Cl.[3] ..... F41G 1/38

[52] U.S. Cl. ..... 33/298; 33/246; 356/247

[58] Field of Search ..... 33/298, 297, 246; 356/247

[56] References Cited

U.S. PATENT DOCUMENTS

| | | | |
|---|---|---|---|
| 2,275,631 | 3/1942 | Johnson | 33/298 |
| 2,580,280 | 12/1951 | Bullard | 33/298 |
| 3,902,251 | 9/1975 | Ross | 33/246 |

FOREIGN PATENT DOCUMENTS

| | | | |
|---|---|---|---|
| 811682 | 8/1951 | Fed. Rep. of Germany | 33/298 |
| 598306 | 2/1948 | United Kingdom | 33/246 |

*Primary Examiner*—William D. Martin, Jr.

*Attorney, Agent, or Firm*—K. H. Boswell; Edward D. O'Brian

[57] ABSTRACT

A sighting device completely devoid of any lenses for use in pistol target shooting has a one-piece elongated outer tube having at least one saddle integrally formed on the outer tube and located proximal to one of the ends of said main tube. The saddle has two holes in it passing through the saddle into the interior of the main tube which provide access into the interior of the main tube. The holes are placed on the saddle 90 degrees apart from each other. Located on the saddle over each of the holes is a turret member. A portion of each of the turret members passes through each of the holes into the interior of the main tube. Mounted within the interior of the main tube is at least one elongated inner tube. The inner tube is pivotally mounted within the main tube such that one of its ends is free to move within the interior of the main tube. The portions of the turret members that pass through the holes are operatively connected to this movable end of the inner tube and this end of the inner tube moves within the interior of the main tube in response to movement of the turret members. A reticle composed of two sections which together form a complete reticle has one of its sections located on the movable end of the inner tube and has the other of its sections located within the main tube proximal to the end wherein the saddle is not located. The two sections of the reticle together form a complete reticle when viewed down the longitudinal axis of the sighting device.

8 Claims, 4 Drawing Figures

LENS-FREE SIGHTING DEVICE

BACKGROUND OF THE INVENTION

This invention is directed to a lens-free sighting device primarily useful in pistol target shooting.

Many different types and varieties of telescopic sighting devices are commercially available for use in both target shooting and hunting. In certain classes of pistol target shooting, however, the use of any sighting device which magnifies the target is strictly prohibited. Thus, the normal target pistol telescopic sights cannot be used.

In the above noted target shooting classes not allowing telescopic sighting devices, the target shooter has presently available to him combinations of foresights and backsights. Typically these might include beads or other projections or combinations of these located within an apperture and the like for the front sight. The backsights may simply be a fixed notch or they can include movable backsights which are adjustable for both windage and elevation. These combinations, of course, can be sighted in as is typically done. However, since the foresight and the backsight are not integrally formed into one sighting device they are not located within a single frame of focus and further the target is located in yet another frame of focus. This sometimes results in at least two of either the target, the front sight or the rear sight being fuzzy.

In view of the above it is considered that there exists a need for a pistol sight which fits the criteria that it contains no lenses yet allows the target shooter to sight through the device at the target maintaining both the target and the reticle of the pistol sight within a single frame of focus. Such a sight would allow the target shooter to better concentrate on a single frame or field of sight.

BRIEF SUMMARY OF THE INVENTION

It is an object of this invention to provide a pistol sight which allows the target shooter to maintain but one frame of sight on both the target and the reticle. It is a further object to provide a lensless pistol sight which complies with the first object. It is a further object to provide a pistol sight which is strong and sturdy and able to withstand the recoil shock of certain high caliber target pistols.

These and other objects as will become apparent from the remainder of this specification are achieved by providing a lens-free sighting device which comprises: a one piece elongated outer tube having at least one saddle integrally formed thereon and located proximal to one of the ends of said main tube; said saddle including two holes located 90 degrees apart from each other which pass through the saddle into the interior of the main tube providing accesses to the interior of the main tube; located on the saddle are two turrets, one each over each of said holes such that a portion of each of said turrets can each pass through one of said holes into the interior of said main tube; within the interior of the main tube is at least one elongated inner tube which is pivotally mounted within the main tube such that one of its ends is free to move within the interior of the main tube, this free end is located proximal to the end of the main tube wherein the saddle is located; the portions of the turrets which pass through the holes are operatively connected to the movable end of the inner tube such that the movable end of the inner tube moves within the interior of the main tube in response to movement of the turrets; a reticle having two sections is located such that one of the sections is fixedly attached to the movable ends of the inner tube and the other of the sections is fixedly attached within the main tube proximal to the end of the main tube where the saddle is not located and thus located distal to the other section of the reticle allowing the reticle to be viewed as a single reticle when the target shooter sights along the longitudinal axis of the main tube.

As an alternate embodiment the main tube has a saddle located proximal to both of its ends and each of these saddles each have two holes into the interior of the main tube; a turret is located over each of these holes and two inner tubes are located within the main tube such that one end of each of the inner tubes is free to pivot within the interior of the main tube; two of the turrets are each operatively associated with the pivotal or movable end of each of the inner tubes; a reticle having two sections is mounted within the interior of the main tube by having one of its sections mounted on the movable end of one of the inner tubes and the other of its sections mounted on the movable end on the other of the inner tubes; the two sections of the reticle are thus independently capable of being adjusted by the turrets.

BRIEF DESCRIPTION OF THE DRAWINGS

This invention will be better understood when taken in conjunction with the drawings attached to this specification in which.

Figures 1, 2, 3, 4:
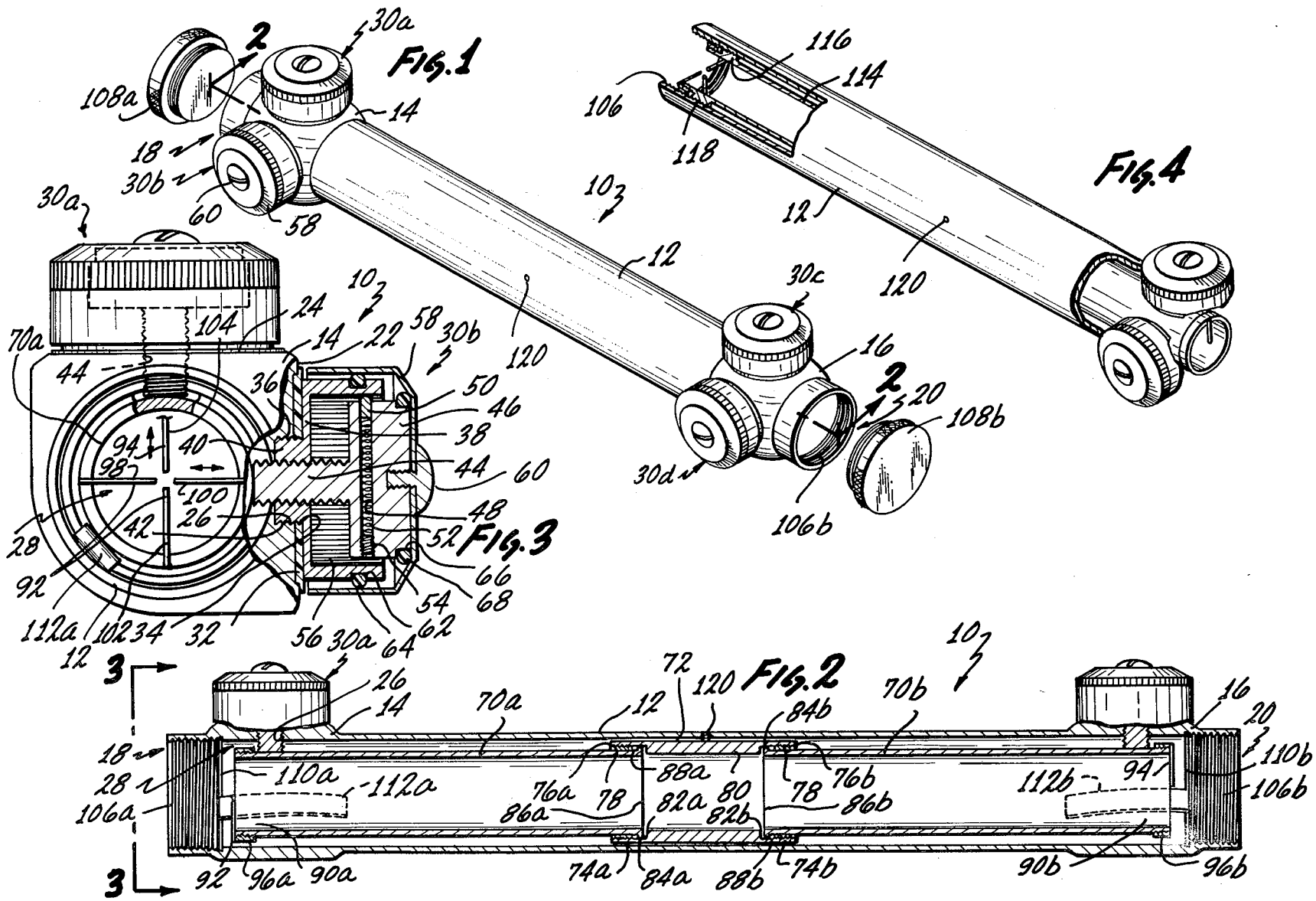
FIG. 1 is an oblique view of one of the embodiments of the invention.
FIG. 2 is a side elevational view in partial section about the line 2—2 of FIG. 1 showing the sighting device of FIG. 1.
FIG. 3 is an end elevational view in partial section about the line 3—3 of FIG. 2 of the sighting device shown in FIG. 1.
FIG. 4 is an oblique view in partial section of an alternate embodiment of the invention.

The invention described in this specification and shown in the drawings utilizes certain principles and concepts which are set forth in the claims appended to this specification. Those skilled in the art to which this invention pertains will realize that the principles and concepts as set forth in the appended claims could be utilized in a variety of differently appearing embodiments than those described in this specification and in the drawing. For this reason this invention is to be construed in light of the appended claims and is not to be construed as being limited to the exact embodiments described in this specification and shown in the drawings.

DETAILED DESCRIPTION

The sighting device 10 for use in pistol target shooting has a one-piece main tube 12 having two saddles 14 and 16 integrally formed with the main tube 12 and positioned proximal to ends 18 and 20 of the main tube 12. The saddles 14 and 16 are identical to each other and both of them completely circumvent the main tube 12. Because both of the saddles 14 and 16 are identical, identical numerals will be utilized to identify identical parts and only the saddle 14 will be described in detail. However, for the purposes of clarity later on in this specification in describing use of this sighting device 10 particular parts which are identical are given the same numbers followed by an alphabetical letter.

The saddle 14 has two flattened sections 22 and 24 located 90 degrees apart such that these flattened sections 22 and 24 if extended would intersect each other at a right angle or at 90 degrees. Projecting from the surface of the flattened sections 22 and 24 are identical holes 26. The holes 26 extend through the saddle 14 into the interior 28 of the main tube 12 and form access to this interior 28. An elevational turret 30-*a* and a windage turret 30-*b* which are wholly conventional in construction are mounted on the flattened sections 22 and 24, respectively. Elevational turret 30-*a* and windage turret 30-*b* are identical in construction; therefore, as noted before only one of them will be described.

A circular plate 32 fits over the surface of flat section 22. Circular plate 32 has a center circular cutout section 34. The interior of hole 26 as well as cutout section 34 are provided with appropriate screw threads 36. A turret base 38 having a hollow upstanding boss 40 having external screw threads 42 located around boss 40 is screwed into hole 26 and cutout section 34. This fixedly locates the turret base 38 on the saddle 14. A threaded member 44 screws into the turret base 42 and projects within the interior 28 of the main tube 12. The threaded member 44 has a cap 46 which has a hole 48 traversing across its diameter. A pointed peg 50 fits within the hole 48 and is biased toward one side of the cap 46 by a spring 52 which in turn is retained within hole 48 by a screw plug 54. Within the interior of turret base 38 is a symmetrical array of ridges collectively identified by the numeral 56.

A turret cover 58 attaches to cap 46 via screw 60. Turret base 38 has a small groove 62 around its exterior. An O-ring 64 fits within this groove 62 and seals the cover 58 to the turret base 38. Along the upper surface of cap 46 is a second groove 66 having an O-ring 68 located within it which fits against and forms a seal between cap 46 and cover 58. Threaded member 44 is turned by cover 58 and peg 50 fits against the ridges 56 which positions and holds the threaded member 44 in a variety of positions with respect to turret base 38. In response to this as cover 58 is turned the threaded member 44 is threaded into or out of the interior 28 of main tube 12.

Located within the interior 28 of main tube 12 are two identical inner tubes 70-*a* and 70-*b*. Centrally positioned within the interior 28 of main tube 12 is a middle tube 72. Both of the ends 74-*a* and 74-*b* of middle tube 72 have internal screw threads 76-*a* and 76-*b*. Identical lock rings 78 screw into these screw threads 76. The central portion 80 of middle tube 72 is raised or is thicker than the remainder of the middle tube 72. When lock rings 78 are screwed into middle tube 72 a space 82-*a* and 82-*b* is formed on either end of the middle tube 72 between the lock rings 78 and the central portion 80.

An annular flange 84-*a* 84-*b* extends around the ends 86-*a* and 86-*b* of inner tubes 70-*a* and 70-*b*. When the inner tubes 70-*a* and 70-*b* are properly positioned within the main tube 12 the annular flanges 84-*a* and 84-*b* are located in the spaces 82-*a* 82-*b* between the lock rings 78 and the central portion 80 of middle tube 72. These flanges 84 are so locked by first positioning the ends 86 of inner tube 70 in middle tube 72 followed by insertion of an O-ring 88-*a* and 88-*b* over the inner tubes 70-*a* and 70-*b* and finally attaching the lock rings 78-*a* and 78-*b*. This provides pivoting of the inner tubes 70-*a* and 70-*b* about their ends 86-*a* and 86-*b* within the interior 28 of the main tube 12.

On the other end 90-*a* of inner tube 70-*a* is mounted one section 92 of a split reticle. The other section 94 of this split reticle is mounted on end 90-*b* of inner tube 70-*b*. The split reticle sections 92 and 94 each contain a ring 96-*a* or 96-*b* which is screwed onto the appropriate end 90. Many different reticle designs can be used. As illustrated end 90-*a* has two horizontal wires 98 and 100 and vertical wire 102 while reticle section 94 has the corresponding second vertical wire 104. The use of the rings 96 allows interchangeability of many reticle designs.

Both ends 18 and 20 of main tube 12 have internal screw threads 106-*a* and 106-*b* formed thereon. These screw threads 106-*a* and 106-*b* receive protective caps 108-*a* and 108-*b* which serve to keep dust and other contaminants out of the interior of the sighting device 10 when it is not in use.

Located proximal to the screw threads 106 is an annular groove 110-*a* and 110-*b*. A spring 112-*a* and 112-*b* having a notch on its end is appropriately placed within the interior 28 of main tube 12 such that the notch (not separately numbered or identified) is retained in the annular grooves 110. The spring 112 is a leaf-type spring and it is compressed between the main tube 12 and the inner tubes 70-*a* and 70-*b*. The spring 112 is positioned such that it is approximately 135 degrees away from both turrets 30-*a* and 30-*b*. This biases the inner tube 70 toward a point mid-point between the two turrets 30-*a* and 30-*b*. Thus, one spring can be used to counteract the action of the turrets as follows. The thread members 44 rest against the side of the inner tube 70. The inner tube 70 is therefore located in a triangular arrangement between the thread members 44 of both turrets 30-*a* and 30-*b* and the spring 112.

In the embodiment illustrated in FIGS. 1 through 3 use is made of two internal tubes 70-*a* and 70-*b* and four turrets 30-*a*, 30-*b*, 30-*c*, and 30-*d*. Turret 30-*a* is used to adjust the elevation for reticle section 92. Turret 30-*c* is used to adjust the elevation for reticle section 94. Turret 30-*b* is used to adjust the windage of reticle section 92 and turret 30-*d* is used to adjust the windage of turret section 94. This allows for a compound adjustment of the reticle sections 92 and 94 rendering possible very accurate sighting of the sighting device 10 and the pistol to which it is attached.

In FIG. 4 there is shown an alternate embodiment wherein only one of the reticle sections is adjustable. In this alternate embodiment the adjustable reticle section is appropriately mounted within an inner tube as previously described. The other reticle section is mounted within inner tube 114 which is mounted to middle tube 72 as previously described but located near the other end of inner tube 114 is an annular flange 116 having a set of external screw threads 118 which screw into screw threads 106 on main tube 12. This fixedly holds inner tube 114 within main tube 12. For both embodiments shown in FIGS. 1 through 4 the middle tube 72 is appropriately attached to main tube 12 by a plurality of small set screws 120. The sighting device 10 is mounted to a pistol using mounting rings (not shown or numbered). The saddles 14 and 16 can serve a purpose additional to that described in regard to the turrets. Because the saddles 14 and 16 are integrally formed with main tube 12 the mounting rings can be snugged up against the saddles which prevent the sighting device 10 from any movement within the scope mounting rings. If the mounting rings, because of their placement on the pistol, do not exactly fit within the saddles appropriate annular shims can be used to provide a solid surface between the mounting rings and the saddles 14 or 16.

Because the reticle sections 92 and 94 are located within a tubular housing, when in use the target shooter can direct his sole attention to only that field of vision which is outlined by the sight of the main tube 12. This is essentially illustrated in FIG. 3 wherein both of the reticle sections are shown to merge into a single reticle and if a target had been shown in the drawings this target would be placed directly behind the reticle. While both reticle sections and the target are not all in absolute sharp focus, the location of all of these within the sight of the tube 12 assists in maintaining a better intuitive feeling of focus between the reticle sections 92 and 94 and the target.

What is claimed is:

1. A lens-free sighting device which comprises:

a one-piece elongated main tube having at least one saddle integrally formed thereon and located proximal to one of the ends of said main tube, said saddle including two holes located 90 degrees apart from each other and passing through said saddle forming two accesses into the interior of said main tube;

two turret means located on said saddle, one over each of said holes such that a portion of each of said turret means pass through one of said holes into the interior of said main tube;

at least one elongated inner tube pivotally mounted within the interior of said main tube such that at least one of the ends of said inner tube is free to move within the interior of said main tube, said free end located proximal to the end of said main tube wherein said saddle is located;

said portions of said turret means passing through said holes operatively connected to said movable end of said inner tube so as to cause said movable end of said inner tube to move within the interior of said main tube in response to movement of said turret means;

a reticle means having two sections, one of said sections fixedly located on said movable end of said inner tube so as to move in response to movement of said inner tube, the other of said sections located proximal to the end of said main tube wherein said saddle is not located, said two sections of said reticle means together forming a complete reticle when viewed along the longitudinal axis of said main tube.

2. The sighting device of claim 1 wherein:

said saddle completely circumvents said main tube forming a thickened and raised portion around the total perimeter of said main tube.

3. The sighting device of claim 2 including:

a biasing means located within the interior of said main tube proximal to said end where said saddle is located and positioned between said main tube and said inner tube approximately 135 degrees radially from each of said holes, said biasing means biasing said inner tube away from said point wherein said biasing means is located and toward a point approximately midpoint between said hole;

said portions of said turret means passing through said hole abutting against said inner tube.

4. The sighting device of claim 1 including:

said main tube having two saddles integrally formed thereon and one of said saddles located proximal to one of said ends of said main tube and the other of said saddles located proximal to the other end of said main tube;

each of said saddles including two holes located 90 degrees apart from each other and passing through said saddles forming four accesses into the interior of said main tube;

four turret means, two of said turret means located over each of said holes in one of said saddles, the remaining two of said turret means located one over each of said holes in said other saddle, a portion of each of said four turret means each passing through said hole over which said turret means is located such that said portions of each of said turret means project into the interior of said main tube;

two elongated inner tubes pivotally mounted within the interior of said main tube such that at least one of the ends of each of said inner tubes is free to move within the interior of said main tube, one of said ends of one of said inner tubes located proximal to one of the ends of said main tube, one of said ends of said other inner tube located proximal to the other of said ends of said main tube;

said portions of said turret means located on one of said saddles passing through said holes in said saddle and operatively connecting to the movable end of said inner tube associated with said end of said main tube wherein said saddle is located, said portions of said turret means located on the other of said saddles passing through said holes in said other of said saddles and operatively connecting to the movable end of said other of said inner tubes associated with said other end of said main tube wherein said other saddle is located, each of said portions of said four turret means capable of moving said ends of said inner tubes which it is associated with within the interior of said main tube in response to movement of said turret means;

a reticle means having two sections, one of said sections fixedly located on said movable end of one of said inner tubes so as to move in response to movement of said inner tube, the other of said sections fixedly located on the movable end of said other inner tube so as to move in response to movement of said other inner tube, said two sections of said reticle means together forming a complete reticle when viewed along the longitudinal axis of said main tube.

5. The sighting device of claim 4 wherein:

each of said saddles completely circumvents said main tube forming two thickened and raised portions proximal to each of the ends of said main tube extending around the total perimeter of said main tube.

6. The sighting device of claim 5 including:

two biasing means located within the interior of said main tube, one of said biasing means located proximal to one of said ends of said main tube, the other of said biasing means located proximal to the other of said ends of said main tube, each of said biasing means positioned between said main tube and one of said inner tubes approximately 135 degrees radially from each of said holes in said saddle located in association with each of said tubes, each of said biasing means biasing one of said inner tubes away from said point where said biasing means is located and toward a point approximately mid-point between said holes in said saddle located in association with each of said inner tubes.

7. The sighting device of claim 6 including:

each of said inner tubes having a pivot means located on its end distal to the end wherein said section of said reticle means is located;

each of said inner tubes being less than one-half the length of said elongated main tube;

a pivot holding means located within the interior of said main tube approximately at the midpoint of said main tube, each of said pivot means on each of said inner tubes interacting with said pivot holding means to pivotally maintain each of said inner tubes within the interior of said main tube.

8. The sighting device of claim 7 including:

a middle tube having an outside diameter incrementally smaller than the internal diameter of said main tube, said middle tube located and fixedly held approximately centered within the interior of said main tube;

said pivot holding means operatively associated with said middle tube.

* * * * *